US008075289B2

(12) United States Patent
Takei

(10) Patent No.: US 8,075,289 B2
(45) Date of Patent: Dec. 13, 2011

(54) SCROLL-TYPE FLUID MACHINE INCLUDING THRUST RECEIVING DEVICE

(75) Inventor: Yuji Takei, Takasaki (JP)

(73) Assignee: Sanden Corporation, Isesaki (JP)

( * ) Notice: Subject to any disclaimer, the term of this patent is extended or adjusted under 35 U.S.C. 154(b) by 444 days.

(21) Appl. No.: 12/297,741

(22) PCT Filed: Apr. 10, 2007

(86) PCT No.: PCT/JP2007/057865

§ 371 (c)(1),
(2), (4) Date: Oct. 20, 2008

(87) PCT Pub. No.: WO2007/123015

PCT Pub. Date: Nov. 1, 2007

(65) Prior Publication Data

US 2009/0116988 A1 May 7, 2009

(30) Foreign Application Priority Data

Apr. 21, 2006 (JP) ..... 2006-117819

(51) Int. Cl.
*F01C 1/02* (2006.01)
*F03C 2/00* (2006.01)
*F03C 4/00* (2006.01)

(52) U.S. Cl. ..... 418/55.1; 418/55.3; 418/55.5; 418/57; 418/178

(58) Field of Classification Search ..... 418/55.1–55.6, 418/57, 178, 179
See application file for complete search history.

(56) References Cited

U.S. PATENT DOCUMENTS 4,637,786 A * 1/1987 Matoba et al. ..... 418/55.3

FOREIGN PATENT DOCUMENTS

| | | |
|---|---|---|
| JP | 2-9972 | 1/1990 |
| JP | 2-176178 | 7/1990 |
| JP | 2-227582 | 9/1990 |
| JP | 8-219053 | 8/1996 |
| JP | 8-226390 | 9/1996 |
| JP | 2004-060469 | 2/2004 |
| JP | 2005-248925 | 9/2005 |
| JP | 2005-291151 | 10/2005 |
| JP | 2005-307949 | 11/2005 |

* cited by examiner

*Primary Examiner* — Theresa Trieu
(74) *Attorney, Agent, or Firm* — Cozen O'Connor

(57) ABSTRACT

A scroll-type fluid machine has a fixed scroll (40) fixed in a housing (10), a movable scroll (52) that forms pressure chambers (52) in between the movable scroll (50) and the fixed scroll (40) and is orbitable relative to the fixed scroll (40), a support wall (14) that is provided for the housing (10) and supports thrust load transmitted from the movable scroll (50), and a thrust bearing (74) disposed in between the movable scroll (50) and the support wall (14). The thrust bearing (74) includes a retention hole (76) formed in the support wall (14), a pressure-receiving piece (78) retained in a recess (76), and an abrasion-resistant board (80) that is set in between the movable scroll (50) and the pressure-receiving piece (50) and has a sliding surface that comes into sliding contact with the pressure-receiving piece (78).

9 Claims, 5 Drawing Sheets

SCROLL-TYPE FLUID MACHINE INCLUDING THRUST RECEIVING DEVICE

RELATED APPLICATIONS

This is a U.S. National Phase Application under 35 USC 371 of International Application PCT/JP2007/057865 filed on Apr. 10, 2007.

This application claims the priority of Japanese patent application no. 2006-117819 filed Apr. 21, 2006, the content of which is hereby incorporated by reference.

TECHNICAL FIELD

The present invention relates to a scroll-type fluid machine, and more specifically, to a thrust-receiving structure.

BACKGROUND ART

For example, a scroll-type fluid machine that is applied as a compressor of a refrigeration circuit has fixed and movable scrolls in a housing. The fixed and movable scrolls form pressure chambers in consort with each other.

The movable scroll is caused to make an orbiting movement relative to the fixed scroll. In response to this orbiting movement, a refrigerant (working fluid) within the refrigeration circuit is drawn into the pressure chamber and compressed in the pressure chamber. The compressed refrigerant is subsequently discharged from the pressure chamber through a discharge port of the compressor toward a condenser of the refrigeration circuit.

In the refrigerant compression process, the pressure of the refrigerant becomes high within the pressure chamber, so that the movable scroll is applied with high thrust load. This thrust load functions to move the movable scroll away from the fixed scroll in its axial direction.

The thrust load hampers the smooth orbiting movement of the movable scroll. The compressor is therefore provided with a thrust-receiving device, namely a thrust bearing, in between a support surface of the housing and the movable scroll. The scroll-type fluid machines disclosed in Unexamined Japanese Patent Application Publication Nos. 2005-248925, 2005-291151 and 2005-307949 each have a plurality of pressure-receiving pieces serving as a thrust bearing, the pieces being arranged in a circumferential direction. Each pressure-receiving piece is made, for example, of PPS (Poly Phenylene Sulfide) resin or the like, and is retained in a retention hole or groove that is formed in the support surface of the housing.

In each of the scroll-type fluid machines described in the above publications, the movable scroll slides against the pressure-receiving pieces. The sliding surface of the movable scroll, which slides against the pressure-receiving pieces, is generally made of an alumite film. It is known that the alumite film has a function not only as an oxidation-resistant film but also as an abrasion resistant-film for being excellent in capability of retaining lubricating oil because of its porosity.

On the other hand, the alumite film has a rough surface, so that alumite abrasion dust is produced during an initial running-in period. The abrasion dust works as abrasive, and roughens the sliding surfaces of the pressure-receiving piece and the movable scroll. Once roughened, the pressure-receiving piece is worn by abrasive wear. When the pressure-receiving piece gets thinner along with the abrasion, a gap is created between the fixed and movable scrolls. In result, the airtightness of the pressure chambers is reduced. This causes a leakage of a working fluid from the pressure chambers, leading to a degradation in compression performance. Compression efficiency and volumetric efficiency are also reduced.

One way to avoid the reduction of the compression efficiency and the volumetric efficiency is to decrease the surface roughness of the sliding surface of the movable scroll. It is bothersome, however, to grind the sliding surface of the movable scroll after the alumite film is formed. Moreover, a device for performing such a process needs to be installed, and manufacturing cost will be increased.

DISCLOSURE OF THE INVENTION

The present invention has been made in light of the above-mentioned circumstances. It is an object of the invention to provide a scroll-type fluid machine including a thrust-receiving device that secures a good sliding ability with a simple structure, and being capable of preventing a reduction in compression efficiency and volumetric efficiency.

In order to accomplish the object, the scroll-type fluid machine of the invention has a fixed scroll that is fixed in a housing, a movable scroll that forms a pressure chamber in between the movable and fixed scrolls and is orbitable relative to the fixed scroll, a support wall that is provided for the housing and supports thrust load transmitted from the movable scroll, and a thrust-receiving device that is disposed in between the movable scroll and the support wall. The thrust-receiving device includes a recess formed in the support wall, a pressure-receiving piece that is retained in the recess, and an abrasion-resistant board that is set in between the movable scroll and the pressure-receiving piece and has a sliding surface that slides against the pressure-receiving piece.

In the thrust-receiving device of the scroll-type fluid machine of the invention, the abrasion-resistant board is set in between the pressure-receiving piece and the movable scroll, so that the pressure-receiving piece and the movable scroll do not slide directly against each other. Since the abrasion-resistant board is a separate body from the movable scroll, it is easy to prepare the surface roughness of the sliding surface of the abrasion-resistant board, which slides against the pressure-receiving piece, by polishing or the like. The thrust-receiving device of the fluid machine accordingly suppresses the abrasion of the pressure-receiving piece with a simple structure and secures a good sliding ability over long periods. In the fluid machine, therefore, a gap created between the fixed and movable scrolls is prevented from expanding, thereby maintaining airtightness of the pressure chambers and preventing a reduction in compression efficiency and volumetric efficiency.

Preferably, the scroll-type fluid machine further has positioning means for positioning the abrasion-resistant board in relation to the movable scroll, and the positioning means includes an outer circumferential surface of a boss provided for the movable scroll, a fitting hole provided for the abrasion-resistant board and fitted to the outer circumferential surface of the boss, a positioning pin that is provided to either one of the abrasion-resistant board and the movable scroll, and a positioning hole that is formed in the other one of the abrasion-resistant board and the movable scroll and engaged with the positioning pin.

According to a preferable aspect of the scroll-type fluid machine, the positioning means prevents a relative rotation of the abrasion-resistant board with respect to the movable scroll, so that the sliding movement between the movable scroll and the abrasion-resistant board is suppressed. The abrasion-resistant board is not worn by sliding against the movable scroll, which reliably prevents the expansion of the gap between the fixed and movable scrolls.

The positioning means includes the outer circumferential surface of the boss, the fitting hole of the abrasion-resistant board, and the positioning pin and the positioning hole which are provided for the movable scroll and the abrasion-resistant board, respectively or otherwise. This fluid machine reliably prevents the expansion of the gap between the fixed and movable scrolls with a simple structure.

Preferably, the abrasion-resistant board has a larger external diameter than the movable scroll, and the movable scroll includes a chamfered outer circumferential edge.

According to a preferable aspect of the scroll-type fluid machine, in spite that the external diameter of the abrasion-resistant board is larger than that of the movable scroll, breakage and fracture are prevented in a portion of the abrasion-resistant board, which comes into contact with the outer circumferential edge of the movable scroll, due to the chamfer of the outer circumferential edge of the movable scroll.

Preferably, the abrasion-resistant board has a larger external diameter than the movable scroll, and an outer circumferential portion of the abrasion-resistant board, which is radially expanded beyond the outer circumferential edge of the movable scroll, is curved opposite to the support wall.

According to a preferable aspect of the scroll-type fluid machine, in spite that the external diameter of the abrasion-resistant board is larger than that of the movable scroll, breakage and fracture are prevented in a portion of the abrasion-resistant board, which comes into contact with the outer circumferential edge of the movable scroll, since the outer circumferential portion of the abrasion-resistant board, which is radially expanded beyond the outer circumferential edge of the movable scroll, is curved opposite to the support wall.

Preferably, the sliding surface of the abrasion-resistant board has an average roughness Ra of 1.6 μm or less.

According to a preferable aspect of the scroll-type fluid machine, the sliding surface of the abrasion-resistant board has an average roughness Ra of 1.6 μm or less. Therefore, during an initial running-in period of the pressure-receiving piece and the abrasion-resistant board, abrasion dust is reliably prevented from being produced from the surface of the abrasion-resistant board, and the pressure-receiving piece is prevented without fail from being roughened and worn off.

BEST MODE OF CARRYING OUT THE INVENTION

Figure 1:
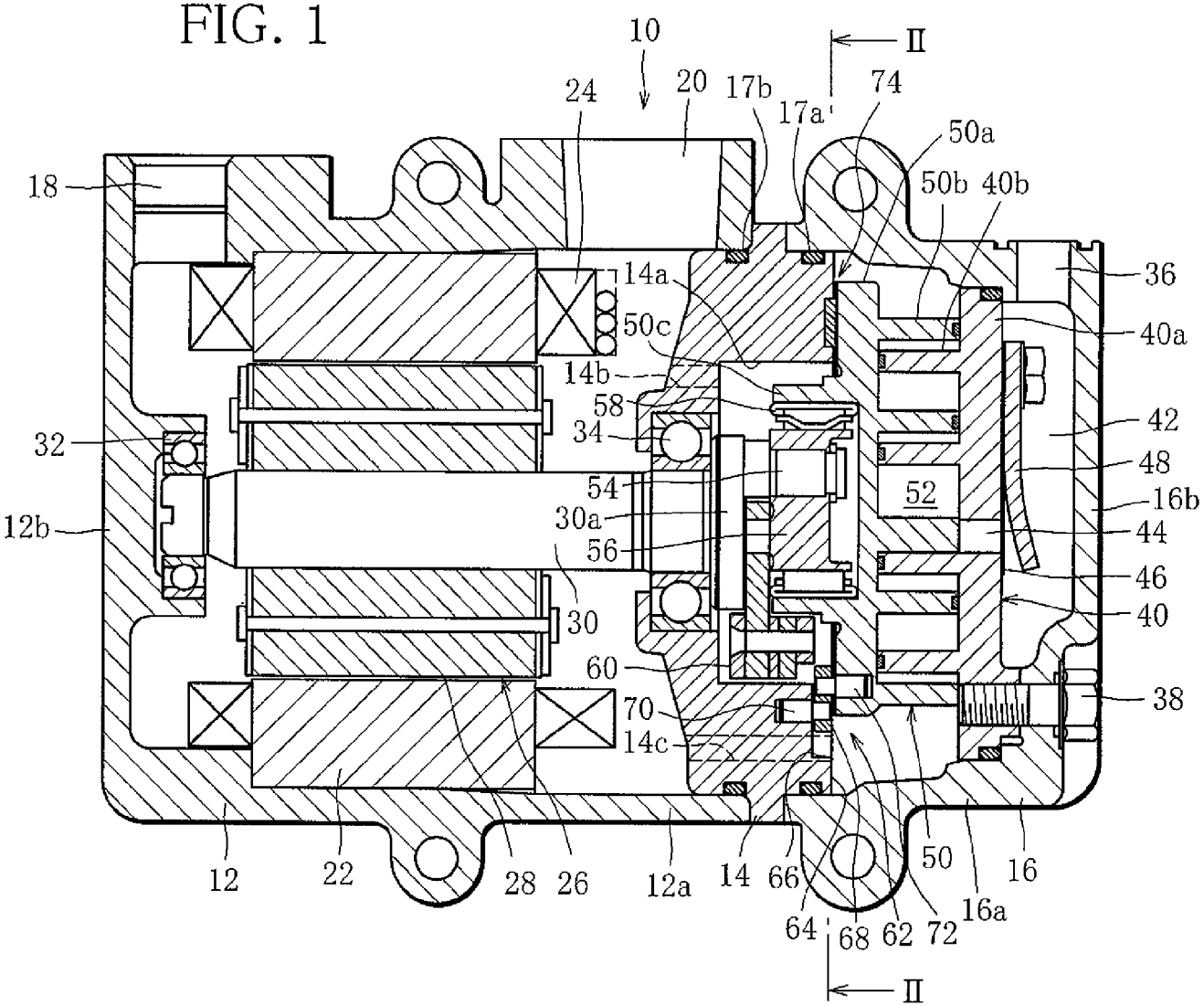
FIG. 1 is a longitudinal sectional view showing a compressor as a scroll-type fluid machine.

FIG. 1 shows a compressor as a scroll-type fluid machine according to an embodiment. This compressor is installed, for example, in a refrigeration circuit of a vehicle air conditioning system and is used to compress a refrigerant (working fluid) in the refrigeration circuit. The refrigerant contains refrigerating machine oil working as lubricating oil. The refrigerating machine oil is supplied to bearings and various sliding surfaces in the compressor together with the refrigerant, to thereby lubricate these bearings and sliding surfaces.

The compressor includes a substantially cylindrical housing 10. The housing 10 has a drive casing (motor casing) 12, a support wall 14 and a scroll casing 16 arranged in the order from left to right as viewed into FIG. 1. The drive casing 12 and the scroll casing 16 are coupled together with the support wall 14 interposed therebetween. O-rings 17*a* and 17*b* are set in between an outer circumferential wall 16*a* of the casing 16 and the support wall 14, and between an outer circumferential wall 12*a* of the casing 12 and the support wall 14.

In the outer circumferential wall 12*a* of the drive casing 12, an intake port 18 is formed in an end wall 12*b* side of the drive casing 12. The intake port 18 is connected to a low-pressure side of the refrigeration circuit. A power supply port 20 is formed on the support wall 14 side of the outer circumferential wall 12*a*. The power supply port 20 is closed with a power supply plug, not shown.

A cylindrical stator 22 is fixed in an inner circumferential surface of the outer circumferential wall 12*a*. The stator 22 is located in between the intake port 18 and the power supply port 20. The stator 22 is wound with a coil 24. A lead wire, not shown, is drawn out from the coil 24 and extends airtightly through the power supply plug. The coil 24 can then be externally supplied with power through the lead wire.

An armature 26 is placed radially inside the stator 22. The armature 26 has a cylindrical core 28 made of laminated electromagnetic steel sheets and a rotary shaft 30 extending through the center of the core 28. When the coil 24 is supplied with power, the rotary shaft 30 is allowed to rotate integrally with the core 28.

The rotary shaft 30 extends from the end wall 12*b* of the drive casing 12 to the support wall 14. The rotary shaft 30 has an end on the end wall 12*b* side, which is rotatably supported by a radial bearing 32 placed in a bearing hole of the end wall 12*b*. A shaft hole 14*a* is formed through the center of the support wall 14. The rotary shaft 30 includes a large-diameter end portion 30*a* that is seated in the shaft hole 14*a*. A radial bearing 34 is placed in the drive casing 12 side of the shaft hole 14*a*. A portion of the rotary shaft 30, which is located close to the large-diameter end portion 30*a*, is rotatably supported by the radial bearing 34.

A lubricating-oil supply hole 14*b* is formed in the support wall 14 so as to extend through an inner circumferential portion near the radial bearing 34. The lubricating-oil supply hole 14*b* opens in a step surface located inside the shaft hole 14*a*. The support wall 14 further includes a plurality of communication holes 14*c* extending through an outer circumferential portion thereof.

A discharge port 36 is formed in the outer circumferential wall 16*a* of the scroll casing 16 to be located in the end wall 16*b* side of the scroll casing 16. The discharge port 36 leads to a high-pressure side of the refrigeration circuit. A fixed scroll 40 is fixed in the scroll casing 16 with a fastening bolt 38. A discharge chamber 42 is marked off between a base plate 40*a* of the fixed scroll 40 and the end wall 16*b*. The discharge port 36 opens into the discharge chamber 42.

An O-ring is set in between an outer circumferential portion of the base plate 40*a* of the fixed scroll 40 and the outer circumferential wall 16*a* of the scroll casing 16. In the center of the base plate 40*a*, there is formed a discharge hole 44. The discharge hole 44 is opened and closed with a lead valve 46.

Opening angle of the lead valve 46 is regulated by a valve guard 48. The lead valve 46 and the valve guard 48 are fixed onto a back face of the base plate 40*a* that partitions off the discharge chamber 42.

The fixed scroll 40 has an involute wall 40*b* that is formed integrally with the base plate 40*a* so as to be arranged in the support wall 14 side. The fixed scroll 40 is engaged with the movable scroll 50 having a base plate 50*a* and an involute wall 50*b*. The involute walls 40*b* and 50*b* have shapes defined by involute curves. Accordingly, a plurality of pressure chambers 52 are formed in between the fixed scroll 40 and the movable scroll 50, and the movable scroll 50 is orbitable relative to the fixed scroll 40.

The pressure chambers 52 are created in a radial outside of the fixed and movable scrolls 40 and 50 along with the orbiting movement of the movable scroll 50. The pressure chambers 52 move into a radial inside of the scrolls 40 and 50 while diminishing in capacity at the same timer and then disappear at a radial center of the scrolls 40 and 50. Working fluid is drawn into the pressure chambers 52 from the radial outside. When the pressure chambers 52 reach the radial center, the working fluid in the pressure chambers 52 has pressure higher than a shutoff pressure of the lead valve 46. In result, the working fluid within the pressure chambers 52 is discharged into the discharge chamber 42.

The fixed and movable scrolls 40 and 50 are made, for example, of aluminum alloy. In the surfaces of the scrolls 40 and 50, alumite films are formed by alumite treatment. Tip seals are arranged in edges of the involute walls 40*b* and 50*b*. The tip seals come into sliding contact with the base plates 50*a* and 40*a* of the opposite scrolls 50 and 40 that make relative orbiting movement.

The movable scroll 50 and the rotary shaft 30 are coupled to each other through a conversion mechanism for converting the rotational movement of the rotary shaft 30 into the orbiting movement of the movable scroll 50.

To be more specific, a crank pin 54 is protruding from the large-diameter portion 30*a* of the rotary shaft 30 toward the movable scroll 50. The crank pin 54 is mounted with an eccentric bushing 56. The base plate 50*a* of the movable scroll 50 is located near the support wall 14. A boss 50*c* is formed integrally and concentrically in a back face of the base plate 50*a* on the support wall 14 side. The boss 50*c* is projecting from the back face of the base plate 50*a* into the shaft hole 14*a* of the support wall 14 and receives the eccentric bushing 56 inside. A needle bearing 58 is disposed in between an inner circumferential surface of the boss 50*c* and an outer circumferential surface of the eccentric bushing 56. The needle bearing 58 connects the eccentric bushing 56 and the movable scroll 50 to each other so that they may relatively rotate.

The eccentric bushing 56 is attached with a counter weight 60, which stabilizes the orbiting movement of the movable scroll 50.

A plurality of rotation stoppers 62 are formed in between the movable scroll 50 and the support wall 14. The rotation stoppers 62 prevent the movable scroll 50 from rotating around its own axis during the orbiting movement of the movable scroll 50.

Figure 2:
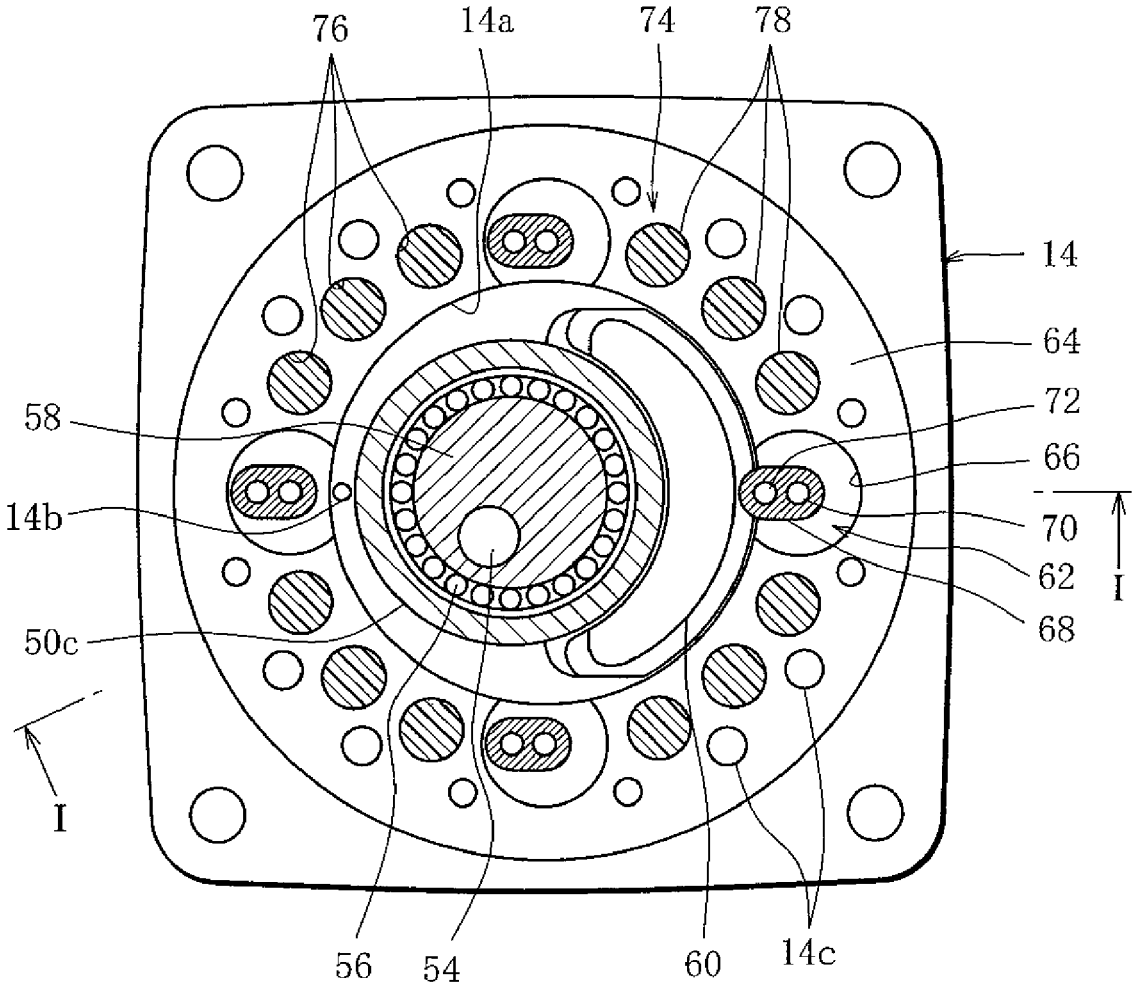
FIG. 2 is a cross sectional view, taken along line II-II of FIG. 1.

More concretely, as illustrated in FIG. 2, the support wall 14 has a ring-shaped support face 64. The support face 64 faces an outer circumferential portion of the base plate 50*a* of the movable scroll 50. In the support face 64, substantially circular-shaped recesses 66 are arranged at equal circumferential intervals of 90 degrees in angle. Each of the rotation stoppers 62 has a link member 68 that is seated in the corresponding recess 66. The link member 68 is relatively rotatably connected to the support wall 14 with a first link pin 70 projecting from the center of a bottom face of the recess 66. The link member 68 is relatively rotatably coupled to the movable scroll 50 with a second link pin 72 projecting from the base plate 50*a* of the movable scroll 50.

FIG. 2 is a sectional view, taken along line II-II in FIG. 1. For the sake of explanation of the support face 64, however, the support wall 14 is shown not in a sectional view but in a plan view.

Figure 3:
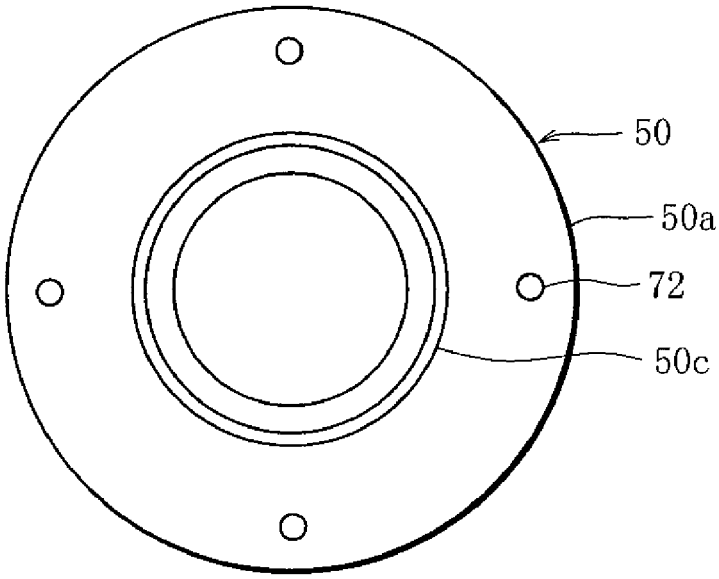
FIG. 3 is a rear view showing a movable scroll that is applied to the compressor shown in FIG. 1 and is attached with second link pins.

As illustrated in FIG. 3, the second link pins 72 are concentrically disposed in a radially more external part than the boss 50*c*. The first and second link pins 70 and 72 are parallel to an axis of the rotary shaft 30 and separated away from each other in a radial direction of the corresponding recess 66. As the movable scroll 50 makes the orbiting movement, the link members 68 of the rotation stoppers 62 rotates around the first link pins 70 within the recess 66, respectively, to thereby block an axial rotation of the movable scroll 50 connected to the link member 68 through the second link pin 72.

A thrust bearing 74 for supporting the thrust load transmitted from the movable scroll 50 is placed in between the movable scroll 50 and the support wall 14.

Referring to FIG. 2 again, the thrust bearing 74 has twelve retention holes 76 formed in the support face 64 of the support wall 14. The retention holes 76 each have a circular shape. The retention holes 76 are arranged so that each three of them are located in an area between the two corresponding adjacent recesses 66 at regular intervals.

Cylindrical flat pressure-receiving pieces 78 are rotatably fitted in the respective retention holes 76. The pressure-receiving pieces 78 may be made of metal, ceramic, synthetic resin, synthetic rubber or the like. From the viewpoint of decreasing the movable scroll 50 in sliding resistance, the pressure-receiving pieces 78 are preferably made of synthetic resin.

Figure 4:
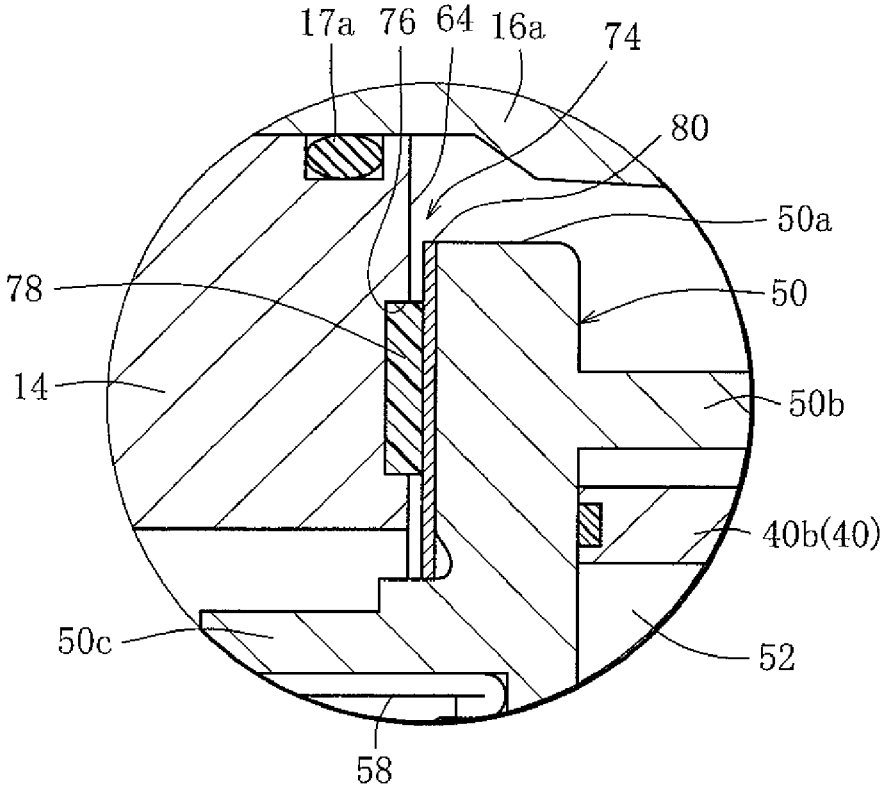
FIG. 4 is a view showing a thrust bearing and its vicinity shown in FIG. 1, in an enlarged scale.

As illustrated in FIG. 4 in an enlarged scale, the pressure-receiving pieces 78 each have thickness larger than the depth of the retention holes 76. While one end faces of the pressure-receiving pieces 78 are in surface contact with bottom faces of the retention holes 76, the other end portions of the pressure-receiving pieces 78 are projecting from the support face 64. A circular ring-shaped flat abrasion-resistant board 80 is set in between the other end portions of the pressure-receiving pieces 78 and the base plate 50*a* of the movable scroll 50. The other end faces of the pressure-receiving pieces 78 come into surface contact with the abrasion-resistant board 80.

Figure 5:
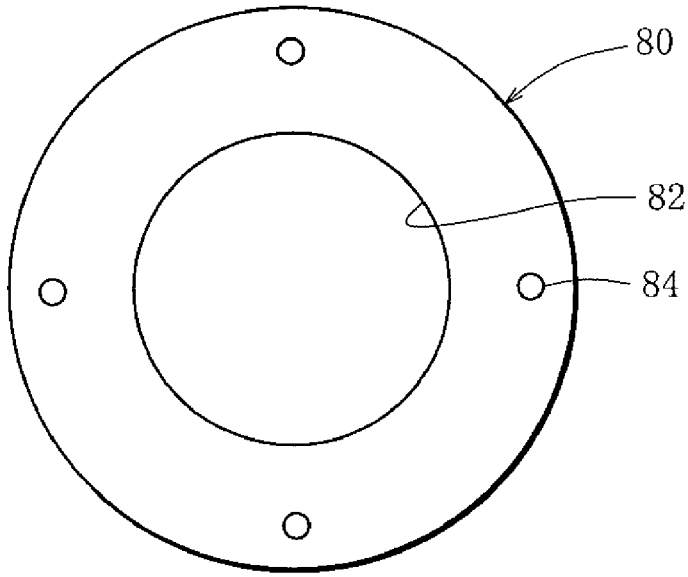
FIG. 5 is a plan view showing an abrasion-resistant board that is used in the thrust bearing shown in FIG. 4.

FIG. 5 is a plan view of the abrasion-resistant board 80, which has a center hole 82 in the center thereof. The abrasion-resistant board 80 has an external diameter that is substantially equal to an external diameter of the base plate 50*a* of the movable scroll 50. The center hole 82 has a bore that is substantially equal to an external diameter of the boss 50*c* of the movable scroll 50.

The abrasion-resistant board 80 has positioning holes 84 in four positions corresponding to the second link pins 72. Each of the positioning holes 84 has a bore substantially equal to an external diameter of each of the second link pins 72.

The boss 50*c* of the movable scroll 50 is fitted in the center hole 82 of the abrasion-resistant board 80, and the roots of the second link pins 72 in the respective positioning holes 84 of the abrasion-resistant board 80. Consequently, the abrasion-resistant board 80 is brought into surface contact with the base plate 50*a* of the movable scroll 50 and is simultaneously positioned so as not to be relatively rotatable with respect to the base plate 50*a*.

The abrasion-resistant board 80 is not particularly limited in thickness and has a thickness of about 0.3 mm, for example. A sliding surface of the abrasion-resistant board 80, which slides against the pressure-receiving pieces 78, is subjected to polishing to be properly reduced in surface roughness. Preferably, an arithmetic average surface roughness Ra of the sliding surface of the abrasion-resistant board 80 is 1.6 μm or less. This is because the creation of abrasion dust, which occurs in an initial running-in period, is surely prevented, and the pressure-receiving pieces 78 are surely prevented from being worn off.

The abrasion-resistant board is not particularly limited in material, but is preferably made of SK material (carbon tool steel material), for the SK material has high abrasion resistance. The sliding surface of the abrasion-resistant board 80, which slides against the pressure-receiving pieces 78, may be constructed of a sliding film formed by surface treatment.

In the above-described compressor, when the stator 22 is supplied with power, the armature 26, namely the rotary shaft 30, starts rotating. The rotational movement of the rotary shaft 30 is converted into the orbiting movement of the movable scroll 50. Along with the orbiting movement, a series of processes is implemented, including the steps of drawing the refrigerant into the pressure chamber 52, compressing the refrigerant within the pressure chamber 52, and discharging the refrigerant from the pressure chamber 52 into the discharge chamber 42. In other words, the refrigerant is drawn from the low-pressure side of the refrigeration circuit into the compressor and is discharged from the high-pressure side of the refrigeration circuit after being compressed in the compressor.

With the above-mentioned thrust bearing 74, the pressure-receiving pieces 78 are dragged by the abrasion-resistant board 80 during the orbiting movement of the movable scroll 50 and then rotated within the retention holes 76. The pressure-receiving pieces 78 accordingly slide against either one or both of the bottom faces of the retention holes 76 and the sliding surface of the abrasion-resistant board 80.

In the thrust bearing 74, the abrasion-resistant board 80 is set in between the pressure-receiving pieces 78 and the movable scroll 50, so that the pressure-receiving pieces 78 and the movable scroll 50 do not slide directly against each other. Since the abrasion-resistant board 80 is a separate body from the movable scroll 50, it is easy to prepare the surface roughness of the sliding surface of the abrasion-resistant board 80, which slides against the pressure-receiving pieces 78, by polishing or the like. The thrust bearing then makes it possible with a simple structure to suppress the abrasion of the pressure-receiving pieces 78 and secure a good sliding ability over long periods. In the compressor, therefore, the gap between the fixed scroll 40 and the movable scroll 50 is prevented from being expanded, and the airtightness of the pressure chambers 52 is retained. This prevents a reduction in compression efficiency and volumetric efficiency.

In the thrust bearing 74, when the second link pins 72 are fitted into the positioning holes 84 of the abrasion-resistant board 80, the relative rotation of the abrasion-resistant board 80 with respect to the movable scroll 50 is prevented with the simple structure. Therefore, the sliding movement between the movable scroll 50 and the abrasion-resistant board 80 is prevented. For this reason, the abrasion-resistant board 80 is not worn by sliding against the movable scroll 50, and the gap between the fixed scroll 40 and the movable scroll 50 is reliably prevented from being expanded.

The invention is not limited to the above-described one embodiment, and may be modified in various ways.

For example, the compressor of the one embodiment includes an electric motor formed of the stator 22, the coil 24 and the armature 26 in the drive casing 12. Instead of the electric motor, however, a pulley and an electromagnetic clutch may be rotatably disposed outside the drive casing. In this case, a portion of the drive casing, which supports the pulley and the electromagnetic clutch so that they are rotatable, is formed as a small-diameter portion. A bearing is interposed between the small-diameter portion and the pulley or the electromagnetic clutch. The pulley and the electromagnetic clutch are connected to an end portion of the rotary shaft 30, which projects from the drive casing.

Although each of the pressure-receiving pieces 78 has a circular shape in a planar view according to the one embodiment, the planar shape of each of the pressure-receiving pieces is not particularly limited and may be a circular arc. Likewise, the number of the pressure-receiving pieces and the shape and number of the recesses for retaining the pressure-receiving pieces may be properly changed to correspond to the planar shape of the pressure-receiving pieces. For example, the recess may be a groove that extends in a circular-arc shape.

Figure 6:
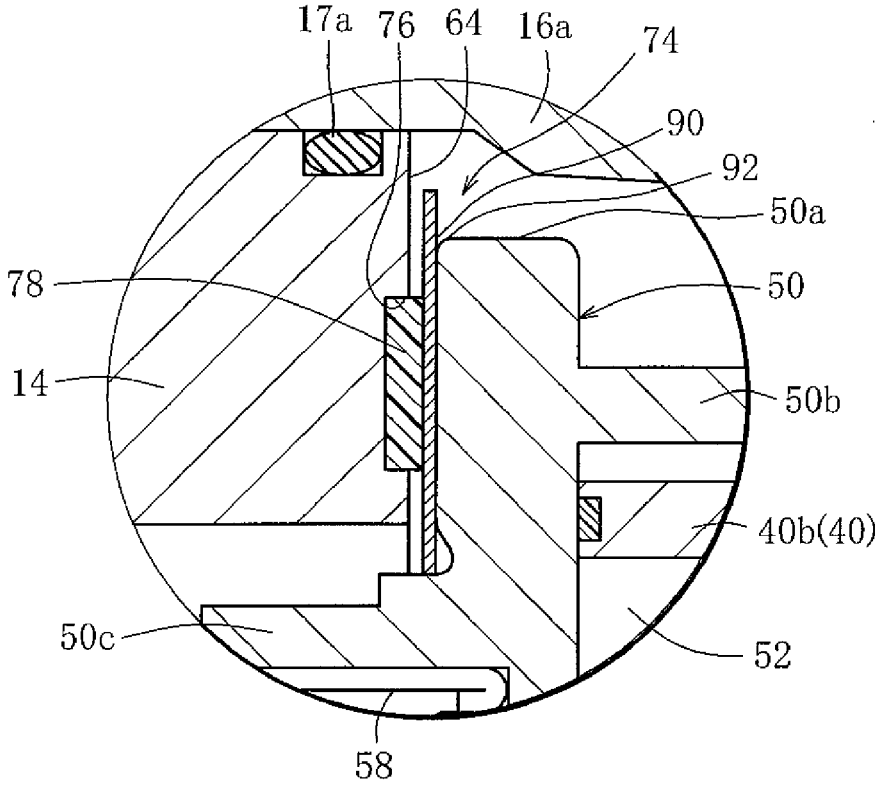
FIG. 6 is a view showing a thrust bearing applying an abrasion-resistant board of a modification example and its vicinity in an enlarged scale.

According to the one embodiment, the external diameter of the abrasion-resistant board 80 is substantially equal to that of the base plate 50*a* of the movable scroll 50. However, the external diameter of the abrasion-resistant board may be smaller or larger than that of the base plate 50*a* of the movable scroll 50. For instance, as illustrated in FIG. 6, an abrasion-resistant board 90 having a larger external diameter than the base plate 50*a* may be used. In this case, it is preferable that an outer circumferential edge 92 of the back face of the base plate 50*a* should be chamfered so that breakage and fracture are prevented in a portion of the abrasion-resistant board 90, which comes into contact with the outer circumferential edge of the back face of the base plate 50*a*.

Figure 7:
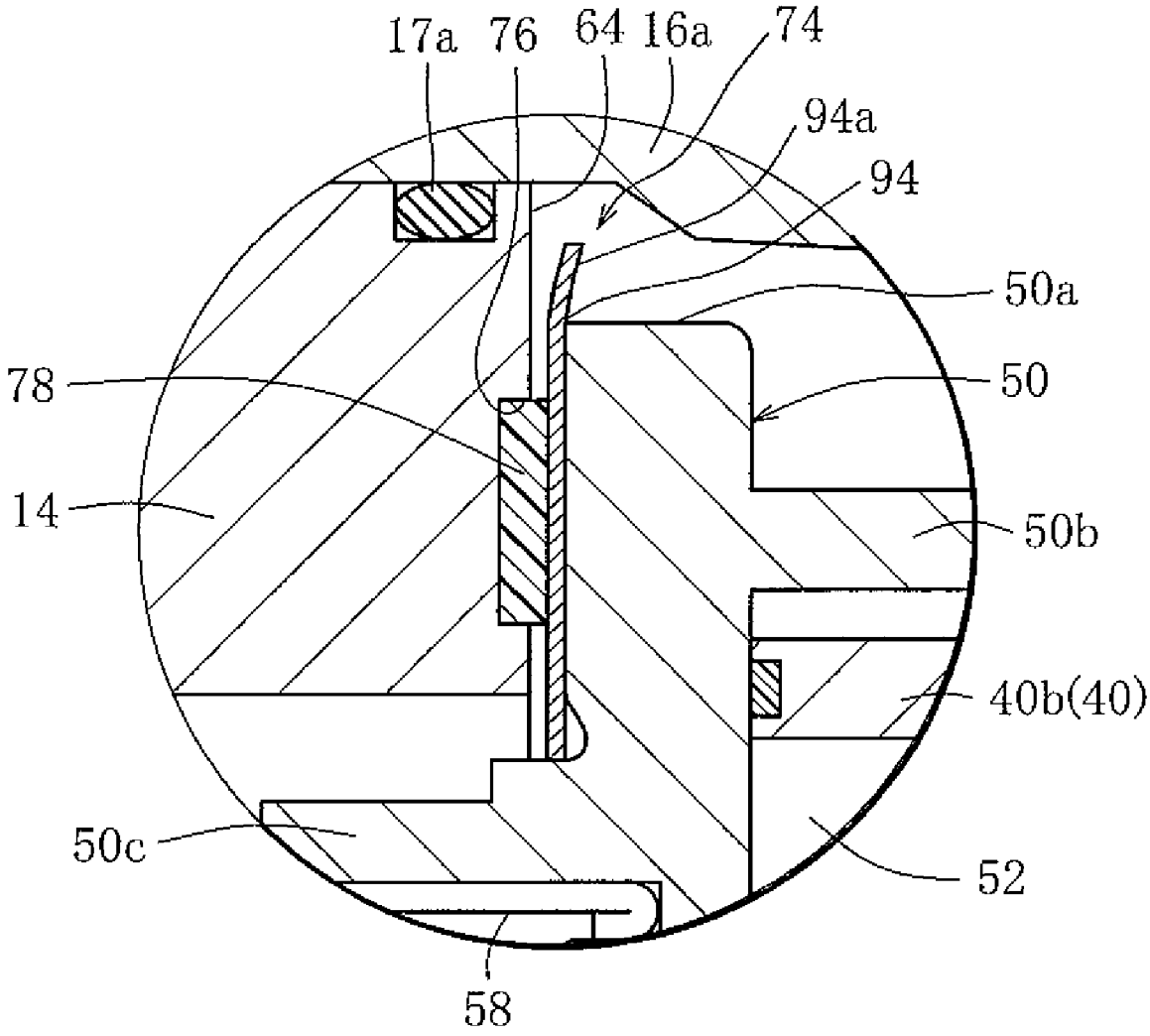
FIG. 7 is a view showing a thrust bearing applying an abrasion-resistant board of another modification example and its vicinity in an enlarged scale.

Instead of the abrasion-resistant boards 80 and 90, an abrasion-resistant board 94 shown in FIG. 7 may be used. The abrasion-resistant board 94 has a larger external diameter than the movable scroll 50 and includes an outer circumferential portion that is radially expanded beyond the outer circumferential edge of the base plate 50*a* of the movable scroll 50, the outer circumferential portion being curved opposite to the support wall 14. Since the outer circumferential portion 94*a* of the abrasion-resistant board 94 is curved, without chamfering the outer circumferential edge of the back face of the base plate 50*a*, breakage and fracture are prevented in a portion of the abrasion-resistant board 94, which comes into contact with the outer circumferential edge of the back face of the base plate 50*a*.

Needless to say, the scroll-type fluid machine of the invention is usable not only as a compressor for a refrigeration circuit that is installed in a vehicle air conditioning system but as a compressor or an expander employed in various fields.

The invention claimed is:

1. A scroll-type fluid machine comprising:

a fixed scroll that is fixed in a housing;

a movable scroll that forms pressure chambers in between the movable and fixed scrolls and is orbitable relative to the fixed scroll, a support wall that is provided for the housing and supports thrust load transmitted from the movable scroll; and a thrust-receiving device that is disposed in between the movable scroll and the support wall, the thrust-receiving device including a hole formed in the support wall, a pressure-receiving piece that is rotatably fitted in the hole, and an abrasion-resistant board that is set in between the movable scroll and the pressure-receiving piece and has a sliding surface that slides against the pressure-receiving piece.

2. The scroll-type fluid machine according to claim 1, further comprising:

positioning means for positioning the abrasion-resistant board in relation to the movable scroll, wherein the positioning means includes an outer circumferential surface of a boss provided for the movable scroll, a fitting hole that is provided for the abrasion-resistant board and fitted to the outer circumferential surface of the boss, a positioning pin that is provided to either one of the abrasion-resistant board and the movable scroll, and a positioning hole that is formed in the other one of the abrasion-resistant board and the movable scroll and engaged with the positioning pin.

3. The scroll-type fluid machine according to claim 2, wherein the abrasion-resistant board has a larger external diameter than the movable scroll, and the movable scroll includes a chamfered outer circumferential edge.

4. The scroll-type fluid machine according to claim 2, wherein the abrasion-resistant board has a larger external diameter than the movable scroll, and an outer circumferential portion of the abrasion-resistant board, which is radially expanded beyond the outer circumferential edge of the movable scroll, is curved opposite to the support wall.

5. The scroll-type fluid machine according to claim 1, wherein the abrasion-resistant board has a larger external diameter than the movable scroll, and the movable scroll includes a chamfered outer circumferential edge.

6. The scroll-type fluid machine according to claim 1, wherein the abrasion-resistant board has a larger external diameter than the movable scroll, and an outer circumferential portion of the abrasion-resistant board, which is radially expanded beyond the outer circumferential edge of the movable scroll, is curved opposite to the support wall.

7. The scroll-type fluid machine according to claim 1, wherein the sliding surface of the abrasion-resistant board has an average roughness Ra of 1.6 μm or less.

8. A scroll-type fluid machine comprising:

a fixed scroll that is fixed in a housing;

a movable scroll that forms pressure chambers in between the movable and fixed scrolls and is orbitable relative to the fixed scroll, a support wall that is provided for the housing and supports thrust load transmitted from the movable scroll; and a thrust-receiving device that is disposed in between the movable scroll and the support wall, the thrust-receiving device including a recess formed in the support wall, a pressure-receiving piece that is retained in the recess, and an abrasion-resistant board that is set in between the movable scroll and the pressure-receiving piece and has a sliding surface that slides against the pressure-receiving piece, wherein the abrasion-resistant board has a larger external diameter than the movable scroll, and the movable scroll includes a chamfered outer circumferential edge.

9. A scroll-type fluid machine comprising:

a fixed scroll that is fixed in a housing;

a movable scroll that forms pressure chambers in between the movable and fixed scrolls and is orbitable relative to the fixed scroll, a support wall that is provided for the housing and supports thrust load transmitted from the movable scroll; and a thrust-receiving device that is disposed in between the movable scroll and the support wall, the thrust-receiving device including a recess formed in the support wall, a pressure-receiving piece that is retained in the recess, and an abrasion-resistant board that is set in between the movable scroll and the pressure-receiving piece and has a sliding surface that slides against the pressure-receiving piece, wherein the abrasion-resistant board has a larger external diameter than the movable scroll, and an outer circumferential portion of the abrasion-resistant board, which is radially expanded beyond the outer circumferential edge of the movable scroll, is curved opposite to the support wall.

* * * * *